United States Patent [19]

Lipschütz

[11] Patent Number: 4,583,148

[45] Date of Patent: Apr. 15, 1986

[54] IGNITION LOCK FOR MOTOR VEHICLES WITH ELECTROMAGNETIC LOCKING

[75] Inventor: Paul Lipschütz, Croissy, France

[73] Assignee: Neiman S.A., Courbevoie, France

[21] Appl. No.: 505,110

[22] PCT Filed: Sep. 18, 1982

[86] PCT No.: PCT/EP82/00205

§ 371 Date: May 20, 1983

§ 102(e) Date: May 20, 1983

[87] PCT Pub. No.: WO83/01083

PCT Pub. Date: Mar. 31, 1983

[30] Foreign Application Priority Data

Sep. 22, 1981 [FR] France ..... 81 17835

[51] Int. Cl.[4] ..... E05B 47/06

[52] U.S. Cl. ..... 361/172; 307/10 AT

[58] Field of Search ..... 361/171, 168, 170, 175, 361/173, 172; 307/10 AT; 340/64, 63; 70/277, 282, 284

[56] References Cited

U.S. PATENT DOCUMENTS

| | | | |
|---|---|---|---|
| 3,142,166 | 7/1964 | Adam et al. | 361/172 |
| 3,644,745 | 2/1972 | Bell | 340/64 |
| 3,870,895 | 3/1975 | Lax et al. | 307/10 AT |
| 3,889,501 | 6/1975 | Fort | 361/172 |
| 4,347,545 | 8/1982 | Weishaupt et al. | 307/10 AT |

*Primary Examiner*—Harry E. Moose, Jr.

*Attorney, Agent, or Firm*—Karl F. Ross; Herbert Dubno

[57] ABSTRACT

An ignition lock for a motor vehicle has a cylinder provided with a recess into which the plunger of an electromagnet can project in the absence of energization of the electromagnet when the ignition switch is in the off position. A remote control circuit for operating the doors of the vehicle is independent of a second circuit for responding to the presence of an appropriate key in the cylinder while a control circuit is responsive to both of these previously mentioned circuits for energizing the electromagnet only when the appropriate signal is received from the remote control unit and when the proper key is inserted in the cylinder so that in the absence of the first-mentioned signal even the proper key will not cause retraction of the plunger to permit the ignition lock to be operated.

4 Claims, 1 Drawing Figure

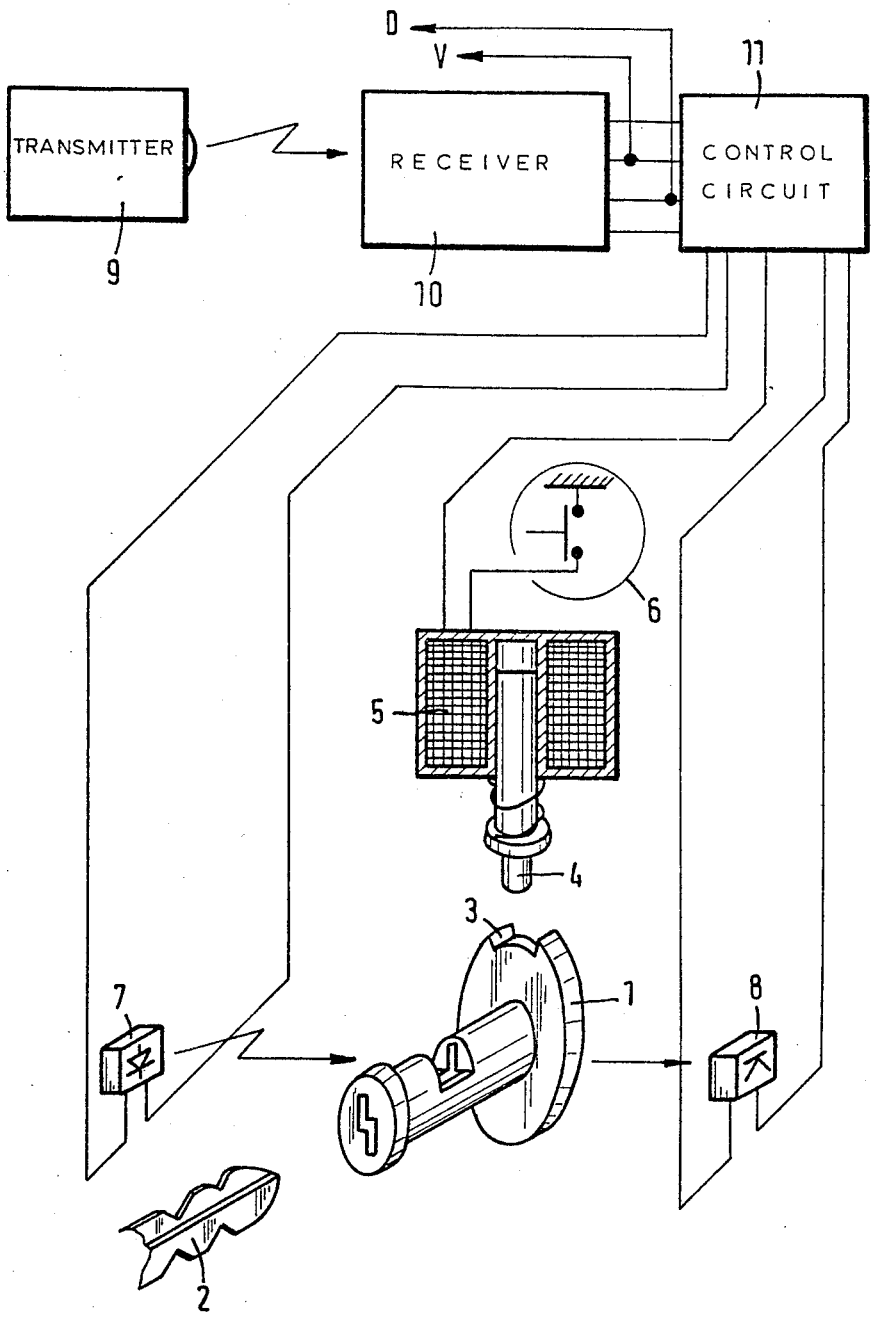
D
V
11
TRANSMITTER
RECEIVER
CONTROL
CIRCUIT
9
10
6
5
4
3
7
1
8
2

IGNITION LOCK FOR MOTOR VEHICLES WITH ELECTROMAGNETIC LOCKING

CROSS REFERENCE TO RELATED APPLICATION

This application is a national phase application corresponding to PCT/EP 82/00205 filed Sept. 18, 1982 and based, in turn, on a French national application 81/17835 filed Sept. 22, 1981.

FIELD OF THE INVENTION

The invention relates to an ignition lock for motor vehicles. More particularly, the invention deals with an ignition lock which is intended to increase the security of ignition locks by ensuring that, as result of electrical blocking of the ignition lock, only the owner of the original ignition key can start up the vehicle.

BACKGROUND OF THE INVENTION

One of the most frequent causes of the theft of motor vehicles is the relative ease with which an ignition key can be acquired or reproduced. All too often, the driver of a vehicle leaves the ignition key inserted in the ignition lock. On the other hand, it is relatively easy for a thief to obtain a reproduction of a key by taking an impression or simply by reading the code number engraved on the key.

Various measures for reducing this risk have already been proposed, for example an acoustic warning signal which sounds when the driver has forgotten to withdraw the key, omission of the engraving of the code number on the key, etc. However, it has not been possible to eliminate the risk of theft completely by these measures.

OBJECT OF THE INVENTION

The object on which the invention is based is, therefore, to increase the safety of an ignition lock which takes effect by the use of a mechanical barrier by means of a lock cylinder.

SUMMARY OF THE INVENTION

The subject of the invention is an ignition lock for a motor vehicle, with a lock cylinder which can be actuated by a key and has a recess which, in the position of rest of the lock, is in line with the plunger of an electromagnet. According to the invention, the electromagnet is located in a circuit which senses the presence of the key in the lock cylinder, and this circuit can be switched by means of a monitoring circuit with coded control.

The monitoring circuit with coded control preferably consists of a secondary circuit of an electronic remote control for the locking and unlocking of the vehicle doors.

In a preferred embodiment, a switch which opens when the engine is started up is located in the circuit feeding the electromagnet. As a result, continued feeding of the electromagnet when the engine is running is avoided.

BRIEF DESCRIPTION OF THE DRAWING

The invention is explained in more detail with reference to the accompanying drawing, the sole FIGURE of which is a diagrammatic representation of an ignition lock according to the invention.

SPECIFIC DESCRIPTION

The ignition lock consists of a lock cylinder 1 which can be actuated by means of a key 2. When the lock cylinder 1 is rotated out of its position of rest, the vehicle is unlocked mechanically, and various circuits (not shown), such as the general circuit of the vehicle, the starter circuit, etc., are closed.

The lock cylinder 1 has on its periphery a recess 3 which, in the position of rest illustrated in the drawing, is in line with a plunger 4 of an electromagnet 5. When current does not flow through the electromagnet 5, the plunger 4 is pressed against the lock cylinder 1 by a spring. The electromagnet 5 is grounded by means of an oil-pressure switch 6, in such a way that current does not flow through the electromagnet 5 when the vehicle engine is running, the pressure switch 6 being then open.

The lock also includes a second circuit which senses the presence of the key 2 in the lock cylinder 1 and which incorporates a luminous diode 7 and a photo-transistor 8. A signal transmitter 9 of a remote-control device for locking and unlocking the vehicle doors acts on a receiver 10 which is connected to the vehicle and forming part of a first circuit receiving coded signals representing authorized use of the vehicle. The signals coming from the receiver 10 are conveyed to an electronic control circuit 11. This control circuit 11 is connected to the luminous diode 7 in such a way that the latter is fed with current when the receiver 10 receives a signal for unlocking the doors (line D), and in such a way that the current supply is interrupted when the receiver 10 obtains a signal for locking the doors (line V). The photo-transistor 8 is connected to the control circuit 11 which feeds the electromagnet 5 when the signal supplied by the photo-transistor 8 is interrupted because the key 2 is inserted in the lock.

The device works as follows. It is assumed that the vehicle is stationary, the engine is switched off, the ignition lock is in the position of rest and the doors are locked. The pressure switch 6 is then closed (when the engine is switched off), but the luminous diode 7 does not receive any current (when the doors are closed). The electronic control circuit does not feed any current to the electromagnet 5, so that the plunger 4 is engaged in the recess 3 of the lock cylinder 1. The ignition lock is blocked and remains thus even if the doors are broken open and a key 2 is inserted in the lock cylinder 1.

Actuation of the signal transmitter 9 generates a train of pulses which is received by the receiver 10. After reading and comparison, the latter sends a continuous signal along the unlocking line D of the first circuit. The continuous signal also fed to the electronic control circuit 11 causes current to be supplied to the luminous diode 7 which now projects light onto the photo-transistor 8. The control or second circuit 11, which obtains a signal from the photo-transistor 8, does not supply any current to the electromagnet 5.

When the key 2 is inserted in the ignition lock, the light beam falling on the photo-transistor 8 is interrupted. The control circuit 11, which has received the unlocking signal and now no longer receives any signal from the photo-transistor 8, closes the circuit of the electromagnet 5. Since the pressure switch 6 is closed, the electromagnet 5 is energized and attracts the plunger 4, with the result that the lock cylinder 1 is released and the starter can be actuated by rotating the key 2.

As soon as the vehicle engine is running, the pressure switch 6 opens, with the result that the supply of current to the electromagnet 5 is interrupted, so that the plunger 4 is no longer retained and is pressed against the periphery of the lock cylinder 1 outside the recess 3 which, after rotation of the lock cylinder 1, is no longer in line with the plunger 4. The pressure switch 6 remains open during the running of the vehicle, and the photo-transistor 8 is not illuminated because of the presence of the key.

When the vehicle is stopped and the key 2 is rotated in the opposite direction, the engine is switched off, so that the pressure switch 6 closes, with the result that the electromagnet 5 is again supplied with current, while the control circuit 11 continues to perform its function. The plunger 4 is attracted and does not penetrate into the recess 3, while the lock cylinder 1 is brought into the position of rest. When the key 2 is withdrawn, the supply of current to the electromagnet 5 is interrupted, and the plunger 4 now penetrates into the recess 3 of the lock cylinder 1 which is thereby locked. When the signal transmitter 9 is actuated, the doors are locked; the continuous signal sent along the line V is also fed to the control circuit 11 which thereupon interrupts the supply of current to the luminous diode 7. The device is now again in the same state as before departure.

I claim:

1. An ignition lock system for an automotive vehicle comprising, in combination:

a lock cylinder for controlling the ignition of a vehicle and rotatable upon insertion of a key into said cylinder properly coordinated with said cylinder, said cylinder being provided along its periphery with a recess;

an electromagnet juxtaposed with said cylinder and having a plunger adapted to engage in said recess in a position of said cylinder in which said recess is aligned with said plunger and in a deenergized condition of said electromagnet whereby said plunger can retain said cylinder against rotation even with a key coordinated to said cylinder inserted in said cylinder;

a first circuit for receiving a coded signal representing authorized use of said vehicle;

means for generating said coded signal whereby said coded signal is received by said first circuit, said first circuit being operable independently of insertion of said key in said cylinder;

a second circuit responsive to insertion of said key in said cylinder for detecting the insertion of a key coordinated to said cylinder; and a control circuit receiving inputs from said first and second circuits for energizing said electromagnet to withdraw said plunger from said recess only upon receipt by said first circuit of a coded signal representing authorized use of the vehicle and independently therefrom a signal from said second circuit engaging the insertion of a key coordinated with said cylinder into said cylinder, said second circuit comprising a luminous diode disposed on one side of said cylinder and a phototransistor disposed on an opposite side of said cylinder, said cylinder having a notch in line with said photodiode and said phototransistor in a position of said cylinder in which said plunger is engageable with said recess and interruptable by the key.

2. The ignition lock system defined in claim 1 wherein said first circuit is part of a circuit of electronic remote control for locking and unlocking doors of said vehicle.

3. The ignition lock system defined in claim 1, further comprising a switch operable to open when an engine of said vehicle is in operation connected in circuit with said electromagnet.

4. The ignition lock system defined in claim 3 wherein said switch is an oil-pressure switch.

* * * * *